US008826789B2

(12) United States Patent
Bagley

(10) Patent No.: US 8,826,789 B2
(45) Date of Patent: Sep. 9, 2014

(54) FABRIC RULER WITH RAISED EDGE GUIDE AND ROTARY CUTTING TOOL WITH GROOVE FOR ENGAGING THE EDGE GUIDES

(76) Inventor: Jim Bagley, Bluffdale, UT (US)

( * ) Notice: Subject to any disclaimer, the term of this patent is extended or adjusted under 35 U.S.C. 154(b) by 557 days.

(21) Appl. No.: 12/572,936

(22) Filed: Oct. 2, 2009

(65) Prior Publication Data

US 2011/0078908 A1 Apr. 7, 2011

(51) Int. Cl.

| | |
|---|---|
| ***B26B 27/00*** | (2006.01) |
| ***B26B 29/06*** | (2006.01) |
| ***B43L 12/00*** | (2006.01) |
| ***B43L 7/00*** | (2006.01) |
| ***B26B 25/00*** | (2006.01) |

(52) U.S. Cl.

CPC ..... *B26B 29/06* (2013.01); *B43L 12/00* (2013.01); *B43L 7/005* (2013.01); *B26B 25/005* (2013.01)

USPC ..... 83/574; 30/292; 30/294; 30/319

(58) Field of Classification Search

CPC ..... B26B 25/00; B26B 29/06; B26B 29/05; B26B 1/08; B26B 1/02; B43L 7/00

USPC ..... 30/286, 289, 291, 292, 31, 293, 282, 30/294, 307; 83/455

See application file for complete search history.

(56) References Cited

U.S. PATENT DOCUMENTS

| | | | | |
|---|---|---|---|---|
| 463,838 | A * | 11/1891 | Johnson | 30/292 |
| 623,000 | A * | 4/1899 | Erkenbreck | 30/292 |
| 636,468 | A * | 11/1899 | Strange | 30/292 |
| 745,517 | A * | 12/1903 | Perks | 30/292 |
| 1,534,576 | A * | 4/1925 | Edgren | 30/292 |
| 2,695,447 | A * | 11/1954 | Maynard | 30/2 |
| 4,779,346 | A | 10/1988 | Schafer | |
| 5,299,355 | A * | 4/1994 | Boda et al. | 30/162 |
| 5,493,781 | A * | 2/1996 | Saito | 30/162 |
| 5,711,077 | A * | 1/1998 | Schulz et al. | 30/160 |
| 5,819,422 | A | 10/1998 | Schafer | |
| 6,643,936 | B2 * | 11/2003 | Carlson et al. | 30/162 |
| 6,839,971 | B2 | 1/2005 | Schafer et al. | |
| 6,854,189 | B2 | 2/2005 | Schafer | |
| 7,073,263 | B2 * | 7/2006 | Kawasaki | 30/292 |
| 7,178,249 | B2 | 2/2007 | Schafer | |
| 7,251,898 | B2 | 8/2007 | Schafer | |
| 7,290,340 | B2 * | 11/2007 | Lin | 30/292 |
| 7,509,745 | B2 | 3/2009 | Schafer et al. | |
| 2003/0110653 | A1 | 6/2003 | Schafer | |
| 2004/0088870 | A1 | 5/2004 | Schafer et al. | |

(Continued)

*Primary Examiner* — Kenneth E. Peterson
*Assistant Examiner* — Jennifer Swinney
(74) *Attorney, Agent, or Firm* — Morriss O'Bryant Compagni

(57) ABSTRACT

Apparatus, systems and methods in accordance with the present invention are related to rotary cutting tools and rulers. In one illustrative embodiment of a system in accordance with the present invention, a ruler for use with a rotary cutting tool has a guide ridge formed as a wall along a cutting edge of the ruler. A hand held rotary cutting tool has a groove in a cutting portion thereof that corresponds to the guide ridge and resides thereon during cutting. The rotary blade of the hand held rotary cutter is maintained in a position adjacent to the cutting edge of the ruler as the cutter is advanced long the ruler cutting edge by the interaction of the groove and the guide ridge. The cutter may include blade guard locking features and a blade depth control for additional safety and control during use.

28 Claims, 9 Drawing Sheets

(56) References Cited

U.S. PATENT DOCUMENTS

2004/0187318 A1* 9/2004 Mathieu et al. ..... 30/319
2005/0132586 A1 6/2005 Schafer
2005/0178013 A1 8/2005 Schafer et al.
2006/0130344 A1 6/2006 Schafer
2007/0175052 A1 8/2007 Schafer et al.

* cited by examiner

FABRIC RULER WITH RAISED EDGE GUIDE AND ROTARY CUTTING TOOL WITH GROOVE FOR ENGAGING THE EDGE GUIDES

TECHNICAL FIELD

The present invention relates to tools for cutting textiles and other materials, and in particular to rotary cutting tools and related items.

BACKGROUND

Rotary cutters are used for cutting fabric in quilt making and hobby sewing, among other uses. Such rotary cutters come in many different designs, each of which includes a handle portion and a "wheel blade" or rotary cutting blade, which is essentially a circular razor blade mounted on axle. The various designs for rotary cutters include differing handle shapes, for ease of use or user preference, with a rotary cutting blade rotatably mounted near one end. Various designs include differing blade guard features which are intended to reduce the potential for injury to a user.

Rotary cutters are typically used with a ruler that is laid on the fabric with the edge of the ruler used to guide the path of the blade during cutting by holding the edge of the blade against the side of the ruler. However, if either the ruler slips on the surface of the fabric during cutting or the cutter wanders from the ruler edge, a user can be injured by the rotary blade. Accordingly, some known rulers have guards that separate the cutting edge of the ruler from the typical placement of a users hand. There are also known rulers that have structures, such as barbs, for attaching to the fabric in order to reduce slipping. While these types of rulers have been able to reduce injuries ruler slippage, the issue of mis-cutting the fabric when the blade wandering away from the ruler remains unresolved.

Accordingly there exists a need for assemblies and devices that address these problems. A system or assembly that allowed for a rotary cutter to be used with a ruler and reduced the tendency for the rotary cutter to wander onto or away from the edge of a ruler during guided cutting would be an improvement in the art.

SUMMARY

Apparatus, systems and methods in accordance with the present invention are related to rotary cutting tools and rulers. In one illustrative embodiment of a system in accordance with the present invention, a ruler for use with a rotary cutting tool has a guide ridge formed as a wall along a cutting edge of the ruler. A hand held rotary cutting tool has a groove in a cutting portion thereof that corresponds to the guide ridge and resides thereon during cutting. The rotary blade of the hand held rotary cutter is maintained in a position adjacent to the cutting edge of the ruler as the cutter is advanced long the ruler cutting edge by the interaction of the groove and the guide ridge. The cutter may include blade guard locking features and a blade depth control for additional safety and control during use.

DESCRIPTION OF THE DRAWINGS

It will be appreciated by those of ordinary skill in the art that the elements depicted in the various, drawings are not necessarily to scale, but are for illustrative purposes only. The nature of the present invention, as well as other embodiments of the present invention may be more clearly understood by reference to the following detailed description of the invention, to the appended claims, and to the several drawings attached hereto.

DESCRIPTION

Figure 1A:
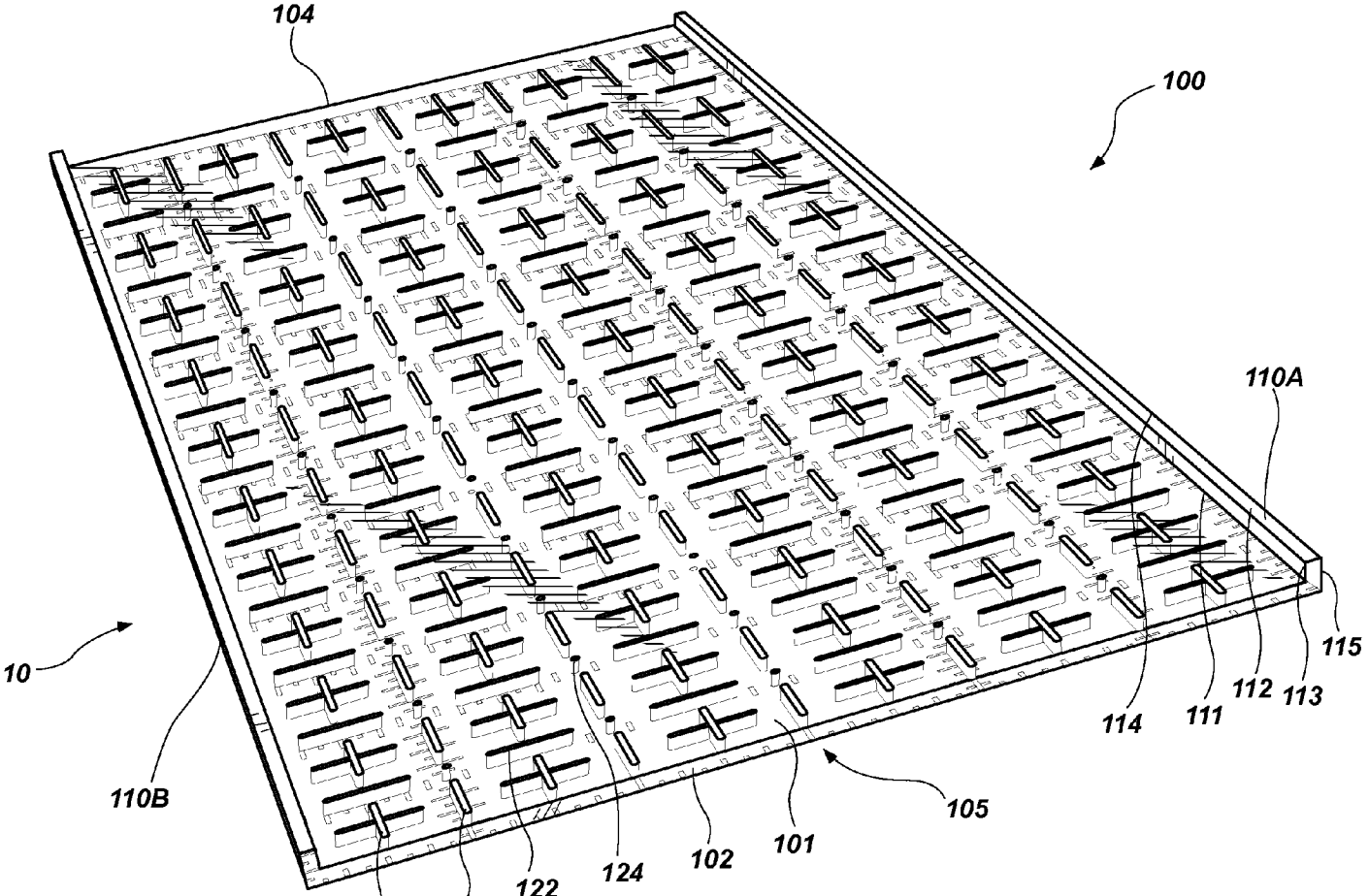
FIGS. 1A and 1B are perspective top and bottom views of an illustrative embodiment of a ruler for cutting sheet materials in accordance with the principles of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1B:
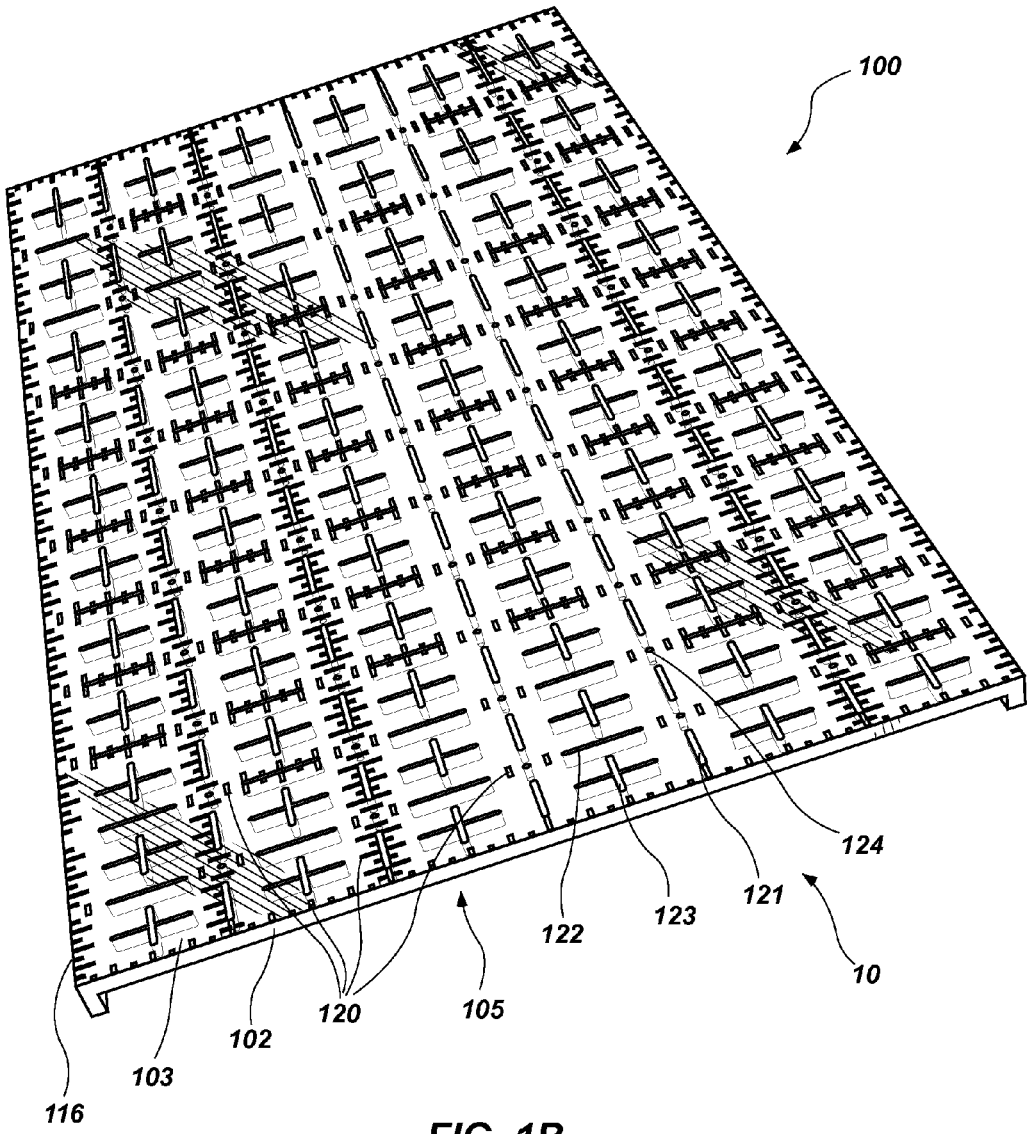

FIGS. 1A and 1B depict a ruler 10 for use in accordance with the systems and methods of the present invention. As depicted ruler 10 has a generally planar body 100 having a rectangular shape. A planar midsection 105 is defined by upper surface 101 and lower surface 103 which extend longitudinally from a first edge 102 to an opposite second edge 104. The longitudinal edges of the ruler 10 are defined by a first guide ridge 110A and an opposite second guide ridge 110B along the edge of body 100.

Each guide ridge 110 is formed as a vertical wall or ridge rising from the upper surface 101 along the entire longitudinal edge of the body 100. An inner sidewall 111 extends from the upper surface 101 of the planar body 100 to intersect ridge top surface 112 at an inner corner 113 that may be rounded. Ridge top surface 112 extends from inner corner 113 to outer corner 114 where it perpendicularly intersects vertical outer sidewall 115, which extends from outer corner 114 to meet a lower surface 103 at a lower corner 116. Each guide ridge functions as a guide for cutting with rotary cutter devices in accordance with the present invention, as discussed further herein.

In some embodiments in accordance with the present invention, ruler 10 may be formed from translucent or transparent materials, allowing a user to view a textile or sheet material which the ruler 10 is placed over during use through body 100.

Ruler 10 includes a number of features to facilitate use in marking and cutting textiles and other sheet materials. For example, length marking indicia may be included on the ruler 10. In the depicted embodiment, such indicia are formed as a series of raised protuberances or bumps 120 disposed on the lower surface 103 of the body 100. As depicted, the indicia may be placed both longitudinally and transversely to create a set of markings that form a grid pattern on the ruler 10. As depicted, these markings reflect may reflect inches and parts thereof, or may be any desired units. By forming the markings as a as a series of bumps 120 on the lower surface 103, the markings act to grip material lying underneath the ruler 10 during use, reducing the likelihood of slipping when cutting or marking.

In addition to bumps 120 the markings may be formed by applying a colored material to the ruler, such as a paint or dye, which may improve visualization of markings disposed on bottom surface 103 when viewed through the body 100 of the ruler. In such embodiments, the paint or dye may be selected to have non-slip properties, such as a relatively high coefficient for friction compared to the body of the ruler, in order to reduce the likelihood of slipping during use.

Planar midsection 105 may feature a number of openings through the body 100 in order to allow for marking materials through the ruler or for the ruler to be secured to underlying material. In the depicted embodiment, there are both longitudinal slots 121 and transverse slots 122 arrayed as a series of lines forming a grid pattern through the ruler 10. Each slot passes through the body 100 from the upper surface 101 to the lower surface 103 and is of sufficient width to allow marking therethrough. Additionally, the depicted embodiment features a pattern of cross-shaped slots 123 formed by intersecting transverse and longitudinal slots that are disposed within the grid pattern of the longitudinal slots 121 and transverse slots 122. Each cross shaped slot 123 similarly passes through the body 100 from the upper surface 101 to the lower surface 103 and is of sufficient width to allow marking therethrough.

In addition to the slots 121, 122, and 123, smaller openings, such as the round pinholes 124 may pass through the body 100 from the upper surface 101 to the lower surface 103. In the depicted embodiment, the pinholes 124 are placed in alignment with the slots 121 and 122, thus forming a part of the grid pattern. In use, a user could place a pin through one or more holes 124 to secure the ruler 10 to an underlying textile or other material in order to further reduce the likelihood of slippage. It will be appreciated that the depicted pattern of slots and holes is only exemplary and any desired pattern useful for marking and cutting sheet materials may be used.

Figure 2B:
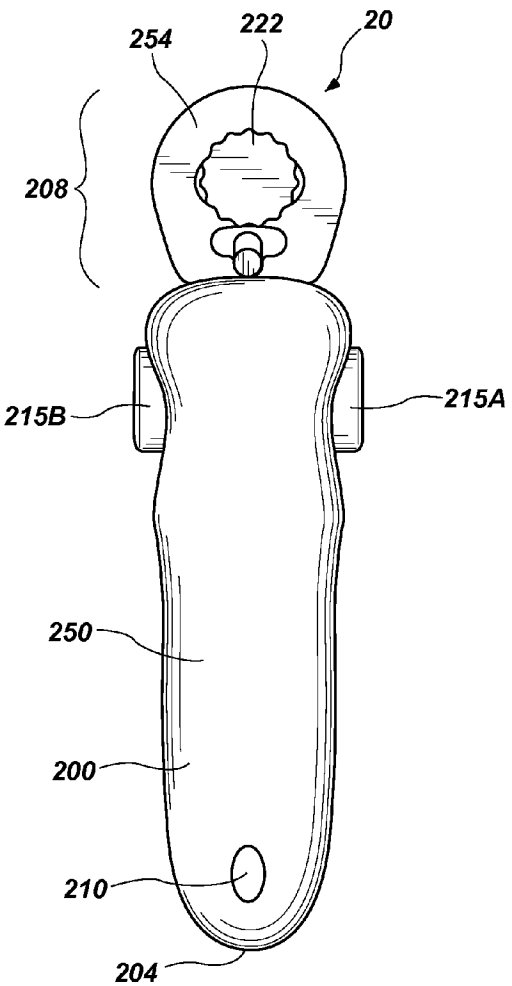
FIGS. 2A and 2B are front and back views of an illustrative embodiment of a hand held rotary cutting tool in accordance with the principles of the present invention.
Figure 2A:
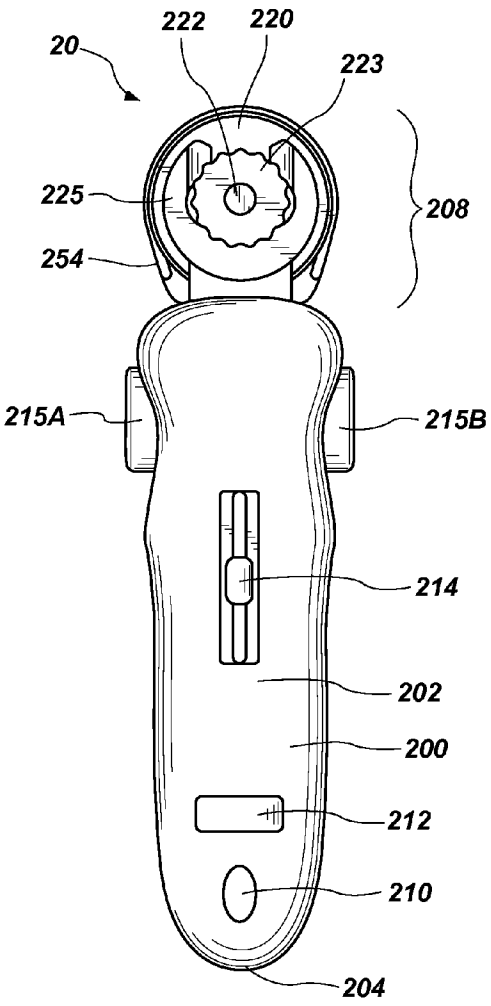

FIGS. 2A and 2B depict a hand held rotary cutting tool 20 in accordance with the principles of the present invention. As depicted the tool 20 includes an outer case 200 which forms a handle for a user of the tool 20. The case 200 may be formed as a two piece unit having a front face 202 which attaches to an opposite back face. Front face 202 and back face 250 are each formed as curved units that attach to one another around their peripheries to form a handle having a tapered bottom end 204 and a wider top end 206. A lanyard hole 210 may be formed through the case 200 near the bottom end 204, as a hole formed by the meeting of sidewall holes formed in each of front face 202 and back face 250, as depicted.

At top end 206, an opening is formed by opposite recesses in the edges of the two faces, from which some components of the cutting portion 208 extend out from the interior of the handle. The visible portions of the cutting portion include rotary blade 220, the axle bolt 222, and retaining nut 223, as well as portions of cutting guide 225, blade guard 252 and guard lock component 254.

A number of functional components are contained within the case 200 and may be actuated by controls accessible at the case 200 to utilize the features of the cutting tool. These various components are discussed further herein.

A locking selector 212 may be disposed on front face 202, which is actuated to select whether guard lock component 254 may be actuated to allow the blade guard 252 to retract from the cutting surface of the rotary blade 220. As depicted, the locking selector 212 may be accessible as a lever type button on the front face 202.

Moving up the handle, a blade guide control or cutting depth selector 214 may also be disposed on the handle. As depicted, this may be a sliding button or knob accessible on the front face 202. Adjustment of the blade guide control determines the deflection of the cutting guide 225 during operation, and thus depth of the cut made by the rotary blade 220.

Near top end 206 two guard release buttons 215A and 2154B are disposed, one each on the opposite sides of the cutter 20 handle. When the locking selector 212 is actuated to allow the blade guard to retract, either guard release button may be depressed by a user to allow the blade guard 252 to retract from the cutting surface of the rotary blade 220. Placement of the guard release buttons 215 at these locations allow a user to operate the cutter 20 in multiple positions and with either hand.

Figure 4:
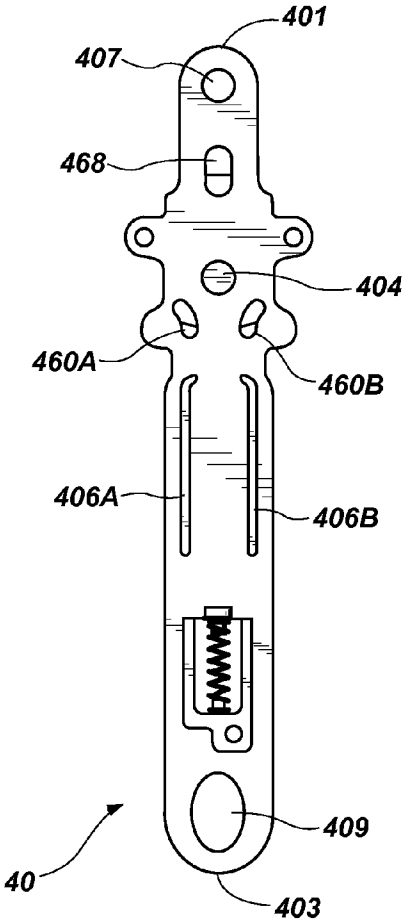
FIG. 4 is a front view of the frame of the hand held rotary cutting tool of FIGS. 2A and 2B.
Figure 3:
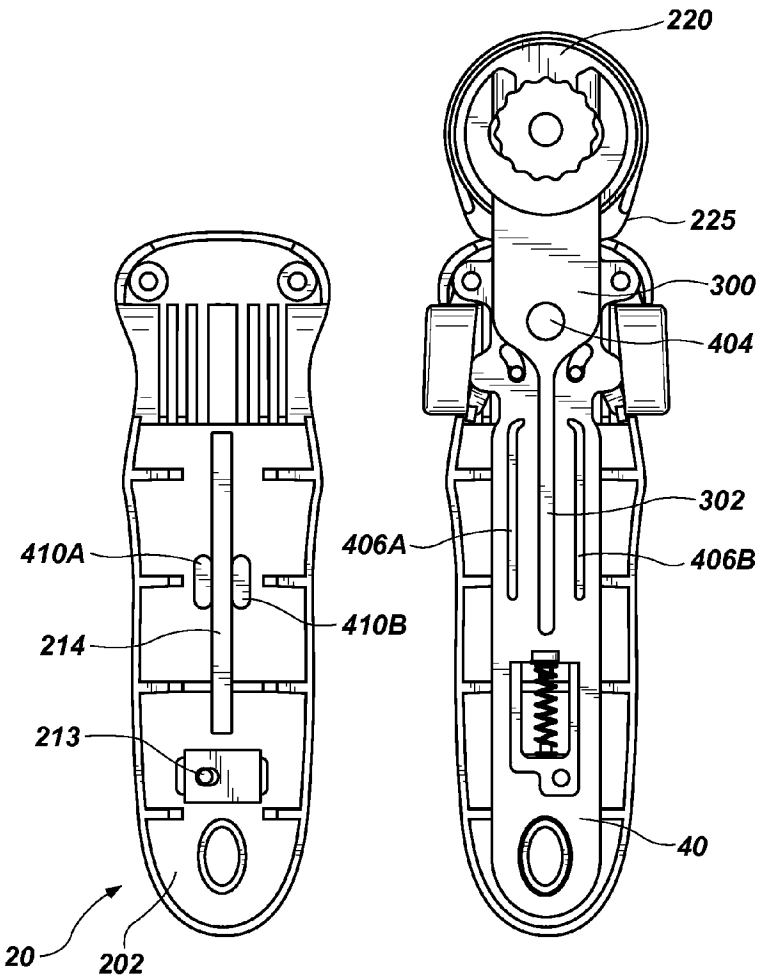
FIG. 3 is a front view of the hand held rotary cutting tool of FIGS. 2A and 2B with the front face of the case removed to reveal internal components.

FIG. 3 depicts the cutter 20 with front face 202 removed to allow additional details of the cutting guide 225 and other components to be viewed. A central cutter frame 40 (depicted in isolation in FIGS. 4 and 7) is formed as an elongate body 40 to which the other cutter 20 components are connected. Cutter frame 40 has a front side 402 with a generally planar configuration from a rounded top end 401 to a rounded bottom end 403. Near top end 401, an axle socket 407 is formed as a circular hole through the body 400. For installation of rotary blade 220, axle bolt 222 may be inserted through the axle socket 407 from the rear side to extending past front face 402. The rotary blade 220 is may be placed thereover and secured with and retaining nut 223.

A second opening may be formed near bottom end 403 which corresponds to lanyard hole 210. Other structures will be discussed in reference to the various components to which they interact.

Figure 5B:
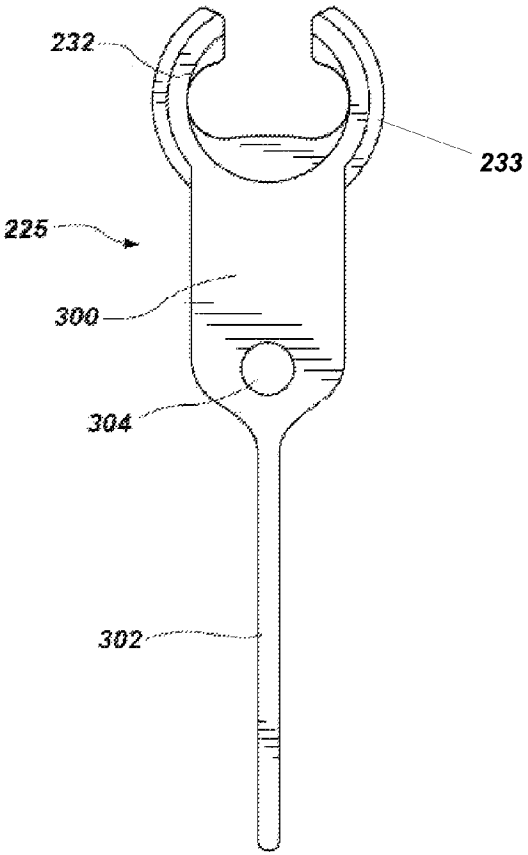
FIGS. 5A and 5B are front and back views of the cutting guide of the hand held rotary cutting tool of FIGS. 2A and 2B.
Figure 5A:
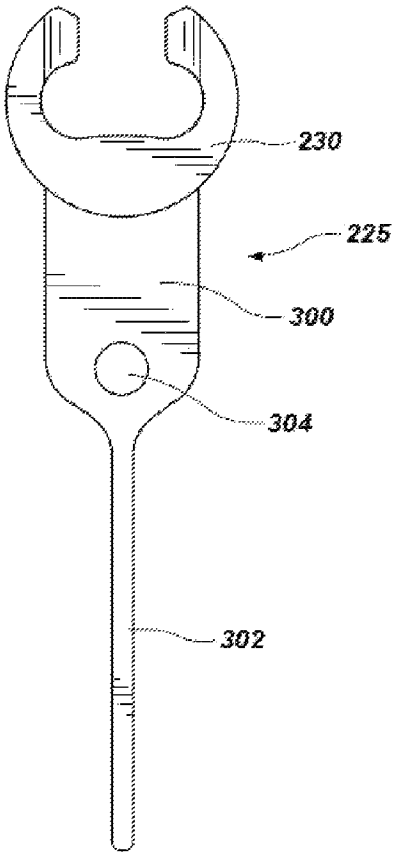
Figure 9:
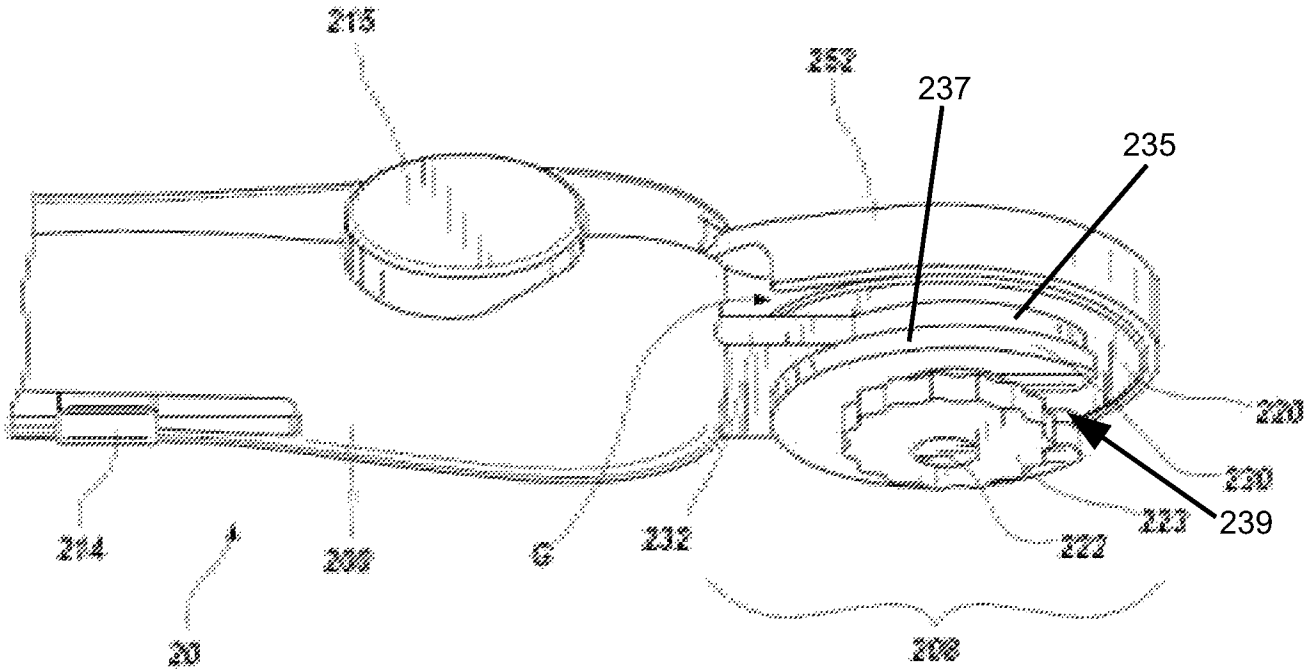
FIG. 9 is a side view of a top portion of the hand held rotary cutting tool of FIGS. 2A and 2B.

Front side 402 of the cutter frame body cutting guide tab 404 formed as a rounded protrusion disposed thereon, with two parallel spaced apart guide retaining walls 406A and 406B disposed therebelow. As depicted in FIGS. 5A and 5B, cutting guide 225 includes a body 300 that extends upward to contiguously form a C-shaped inner portion 232 and an elongated tail portion 302. An attachment hole 304 is formed in the lower portion of body 300 and passes therethrough. Cutting guide 225 includes a larger generally C-shaped outer portion 230 disposed on the smaller diameter C-shaped inner portion 232 as depicted in FIG. 3, upon installation to frame 40, attachment hole 304 resides on cutting guide tab 404, with tail portion 302 extending down the length of front face 402 and residing between the guide retaining walls 406A and 406B. Inner portion 232 lies adjacent the rotary blade 220. As best depicted in FIG. 9, outer portion 230 defines a wall 233 and a guide groove G is defined by the gap between wall 233 and rotary blade 220, with the "floor" of the gap defined by inner portion 232.

The round shapes of attachment hole 304 and cutting guide tab 404 allow the cutting guide to pivot on the guide tab during use, while retaining walls 406A and 406B determine the maximum extent of the pivot by restraining tail portion 302. As depicted, the interior portion of blade guide control or cutting depth selector 214, may be a set of retaining walls 410A and 410 B disposed on the rear surface of the slidable button. As the cutting depth selector 214 is slidably adjusted, retaining walls 410A and 410B move up or down the length of tail portion 302 determining the amount the cutting guide 225 can pivot, and thereby the depth of blade available for cutting by determining the amount of blade 220 that can extend beyond the lower surface of ruler 10 as the guide 110 interacts with the groove G, as discussed in additional detail further herein.

Figure 7:
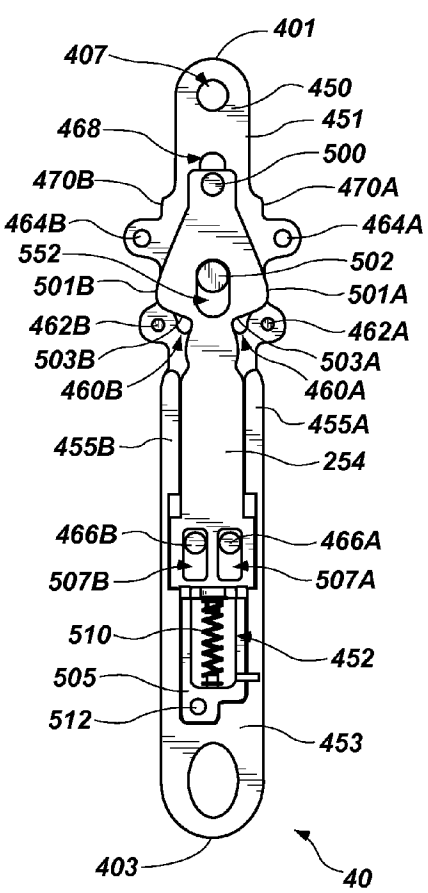
FIG. 7 is a back view of the frame of the hand held rotary cutting tool of FIGS. 2A and 2B.
Figure 6:
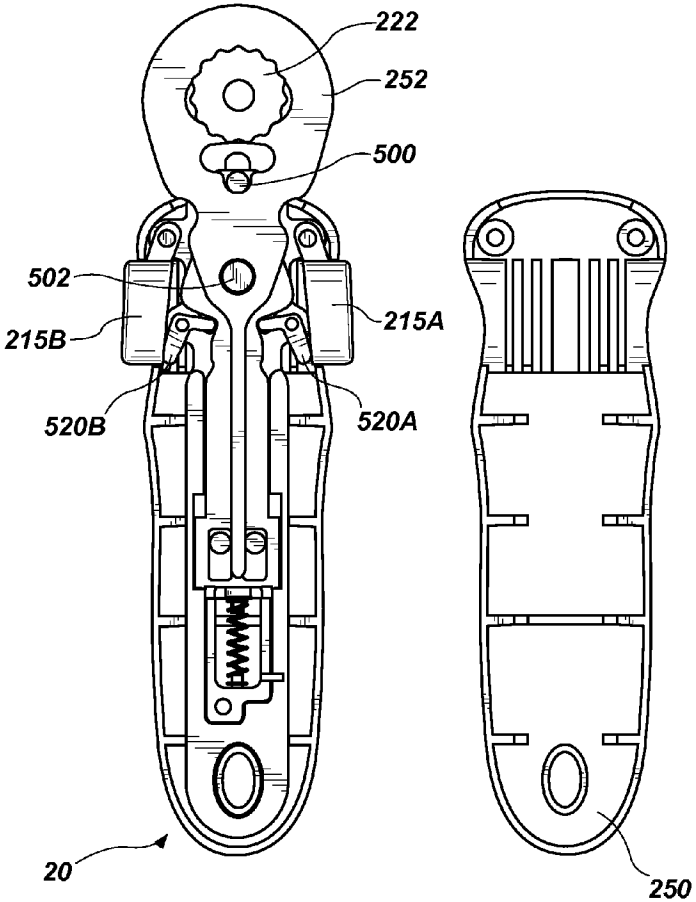
FIG. 6 is a back view of the hand held rotary cutting tool of FIGS. 2A and 2B with the back face of the case removed to reveal internal components.

FIG. 6. depicts the cutter 20 with rear face 250 removed to allow additional details of the blade guard 252 and other components to be viewed and FIG. 7, depicts rear face 250 of cutter frame 40 and guard lock component 254. Cutter frame 40 rear side 450 may have a first planar surface 451 at begging at an upper end thereof at rounded top end 401 and extending downwards along the rear side 450 to locking recess 452, which may be formed as a polygonal recess through the frame 40 above the lanyard hole opening. As depicted, the locking recess 452 as a shape that can be generally described as a large rectangle with a smaller rectangular inset, but it will be appreciated that any desired shape could be used.

A second planar surface 453 which is parallel to the first planar surface 451 is defined by the upper surface of two parallel walls 455A and 455B disposed on the opposite edges of rear side 450, extending from an upper corner 457 downwards to locking recess 452, where the walls widen to define the edges of the locking recess and merge to set a common thickness through bottom end 403. The edges of the walls 455A and 455B thus define side walls of a recess floored by the first planar surface 451.

A number of features are disposed on or though the first planar surface 451. A lock stop recess 468 is formed as an elongated opening with rounded ends place along the midline of frame 40 below axle opening 407. Outwards from the lock stop recess, the frame 40 extends outwards to form two opposite shoulders, each of which has a stop 470A or 470B formed thereon as a raised portion having a sidewall that may extend to an outer surface with that is in a common plane with the second planar surface 453. Below the these shoulders, the frame 40 may again extend outwards on either side to two rounded members that each have a rounded button recess 464A or 464 B for the attachment of a guard release button 215. Downwards from these members, the frame may curve inward and then extend outward to two additional members each of which has a round post 462A or 462B disposed thereon. Inwards from these posts 462A, two mirror image curved slots 460A and 460B may be disposed. Above these posts at a midline of the frame, a guard mounting tab 502 is formed as a rounded post disposed on the planar surface. Near the lower end of the recess floored by the first plane 451, two retaining posts 466A and 466B may be disposed spaced apart from one another across the midline of the frame 40.

Guard stop 254 is slidably placed on the first planar surface 451 in the recess floored thereby, as depicted in FIGS. 6 and 7. A planar rear surface of the guard stop 254 lies adjacent the first planar surface 451 and slides thereon during actuation. A round tab (not depicted) on the rear surface of the guard stop extends into the lock stop recess 468. The guard stop 254 extends from an, upper end near the top end of the frame 40 downwards to a lower end. A locking tab 500 is formed as a rounded post disposed on the outer surface near the upper end. From the locking tab 500, the guard stop 254 extends downwards angling out from the midline in a flared wedge shape to two opposite corners 501A and 501B. From the corners, the guard stop 254 cuts inwards the back outward to form two opposite curved surfaces 503A and 503B near the curved slots 460A and 460B. Above the curved surfaces a mounting opening 552 is formed to allow the guard mounting tab to pass therethrough.

From the curved surfaces 503, the guard stop 254 extends downwards to the locking recess 452 as a planar member. In the depicted embodiment, the guard stop 254 continues into the locking recess with a recess portion 505 that resides within the recess 452. Recess portion 505 may have an upper portion that is coplanar with the rear surface of the guard stop and a lower portion that thickens or widens to the thickness of the frame 40. The recess portion 505 may have a polygonal shape mirroring that of the recess and an opening therethrough to allow a spring 510 or other resilient member to be attached to the frame 40 at the upper end of recess and to guard stop 254 at the lower end of the opening to thereby provide a downwards force on the guard stop 254.

Recess portion 505 may also include a structure for interacting with the locking selector 212. In the depicted embodiment, this is a opening 512 that receives a post 213 disposed on the locking selector 212 inner surface on the front surface 201 of case 200. Depression of the locking selector 212 thus moves the post 213 into and out of the opening 512 to allow slidable movement of the guard stop 254. Above the recess portion 505, two parallel openings 507A and 507B allow the retaining posts 466A and 466B to pass through the body of the guard stop 254.

Returning to FIG. 6, the guard release buttons 215A and 215B each have an oval button portion that extends in line with the body of the frame 40 to be accessible on the side of the cutter 20. Above the button portion a tab extends in a plane parallel to the frame 40. A post disposed on this tab is inserted into the round button hole 464 and allows the button to be pressed inward by pivotal rotation. Two generally L-shaped members 520A and 520B are disposed on the round posts 462A and 462B, with one "leg" of each L contacting each curved surface 503 of the guard stop 254 and the other "leg" extending to the guard release button 215. Inward movement of a guard release button 215 thus presses on the member 520, causing it to rotate and extend one leg across the curved surface 503 moving the guard stop 254 slidably upwards. Upon release of the button 215, the spring 510 returns the guard stop 254 to the lower position.

Figure 8B:
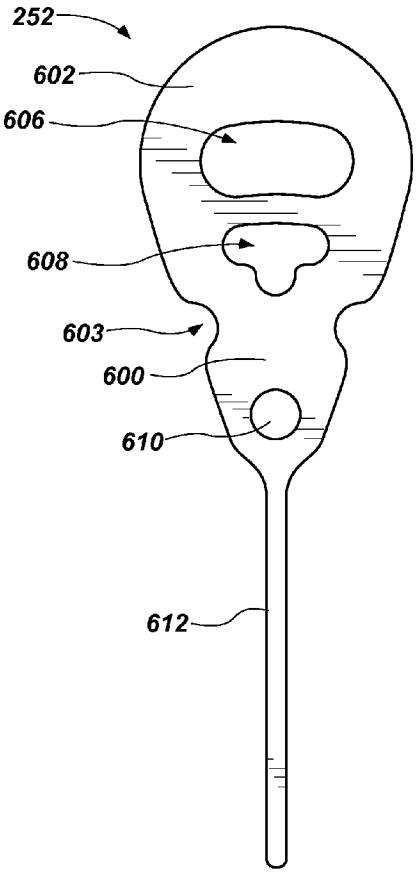
FIGS. 8A and 8B are front and back views of the blade guard of the hand held rotary cutting tool of FIGS. 2A and 2B.
Figure 8A:
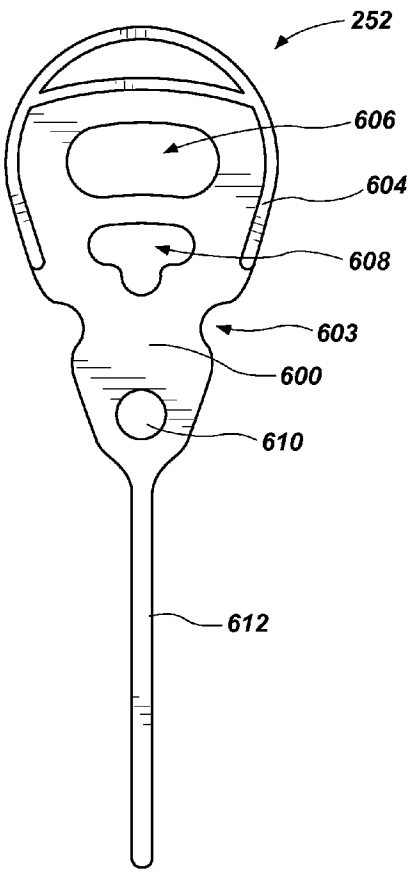

FIGS. 8A and 8B show some additional details of the blade guard 252. Blade guard 252 includes a body 600 that extends upward to form circular or rounded upper end that is slightly larger than the rotary blade 220. Moving downwards, the body 600 tapers inwards, has inset recesses 603, which correspond to the opening in the handle top surface, and then has an elongated tail portion 612. An attachment hole 610 is formed in the lower portion of body 600 and passes therethrough. Above attachment hole 610, a locking opening 608 has a lower locking portion that is sized to receive locking tab 500 and an larger upper portion that extends transversely outwards to rounded ends. Above locking opening 608, axle opening 606 is formed as a generally transverse elongated opening with rounded ends. On the inner surface of the blade guard 252 a wall 604 is disposed around the periphery of the upper end to extend past the frame 40 to a position adjacent the blade 220, when installed.

As depicted in FIG. 6, upon installation to frame 40, attachment hole 610 resides on guard mounting tab 502, with tail portion 612 extending down the length of the frame 402 and residing between the retaining posts 466A and 466B. Similarly, locking tab 500 resides in locking opening 608. The round shapes of attachment hole 610 and cutting guide tab 404 allow the blade guard 252 to pivot on the mounting tab 502 during use, when the locking tab 500 is moved from the lower portion of the locking opening to the upper portion. As pressure is applied to the wall 604 to make a cut, the blade guard pivots, the upper portion of locking opening 608 and the axle opening 606 move with respect to the locking tab 502 and the axle bolt 222 and the edge of the blade 222 is exposed.

Figure 10:
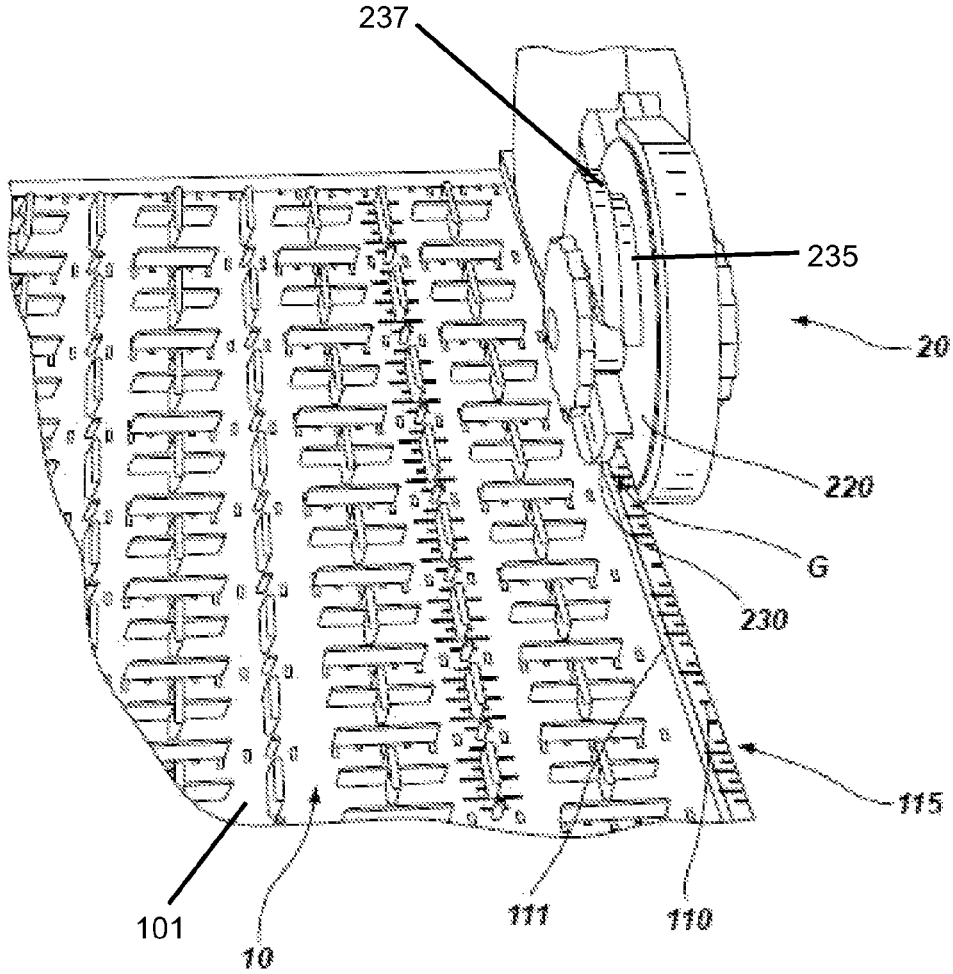
FIG. 10 is a front perspective view of the hand held rotary cutting tool of FIGS. 2A and 2B interacting with the ruler of FIGS. 1A and 1B as a cutting system in accordance with the principles of the present invention.

FIG. 9 depicts some additional details of the cutting portion 208. Axle bolt 222 passes through the blade 220 and central passage 239 of the cutting guide 230. The wall 233 defined by the outer portion 230 of cutting guide 230 defines a guide groove G formed by the gap between wall 233 and rotary blade 220, with the "floor" of the groove defined by the transverse wall 235 of inner portion 232. As depicted in FIG. 10, when a cut is made with the rotary cutter 20 and ruler 10, the groove G may be placed over the ridge 110 along the ruler 10 cutting edge. The ridge top surface 112 may reside on or near the transverse wall 235 surface of inner portion 232 and blade 220 lies against the outer sidewall 115 of the ridge 110, outer portion 230 lies adjacent inner sidewall 111 with curved outer surface 237 over the ruler 10 upper surface 101. This placement of groove G over the cutting ridge thus prevents the cutter 20 from straying away from the ruler 10 during cutting.

Although the guide ridge 230 is depicted herein as having a generally rectangular cross sectional shape with a rounded upper inside corner and groove G is depicted as having a generally rectangular cross section defined by wall 233 and rotary blade 230, it will appreciated that these cross-sectional profiles may vary in order to allow different blades types, rulers with curved shapes or more secure connections to be made. For example, a where a protrusion is formed on the inner sidewall 111 of the guide ridge 110 and a corresponding slot is formed on the surface of the wall 233, this could add an additional point of securement for the cutter 20. Such variance could also allow for the accommodation of different guides.

It will be appreciated that in addition to ruler 10 disclosed herein, that it may be possible to adapt preexisting rulers lacking a ridge 110 along the ruler cutting edge to work as part of a system in accordance with the present invention. For example, a ridge 110 may be marketed as a stand-alone piece that may be attached to the upper surface of an existing ruler along the cutting edge thereof. Such a ruler could then be used with the hand held rotary cutter 20 disclosed herein and obtain a portion of the benefits of the present invention.

Additionally, it is noted that cutter 20 and ruler 10 are discussed above as separate tools that are used together in a system in accordance with the present in invention, but each is also capable of use with other rulers and cutters. It will be appreciated that in some systems in accordance with the present invention, cutter 20 may be securely fixed to the ruler, having a differently designed handle to prevent inadvertent removal. Such a handle could be configured to allow for either left or right handed use.

While the present invention has been shown and described in terms of preferred embodiments thereof, it will be understood that this invention is not limited to any particular embodiment and that changes and modifications may be made without departing from the true spirit and scope of the invention as defined and desired to be protected.

What is claimed is:

1. A system for cutting sheet materials comprising:

a ruler for use with a rotary cutting tool, the ruler comprising a body with a planar section having an upper surface and a lower surface and a guide ridge disposed along an edge of the body, the guide ridge comprising an inner sidewall that extends from the upper surface to a ridge top surface and an outer sidewall extending from the ridge top surface to the lower surface; and a hand held rotary cutting tool comprising a handle and a cutting portion, the cutting portion comprising a rotary blade having two parallel faces and a generally circular cutting edge, an axle passing through rotary cutting blade, a retainer disposed on the axle to secure the rotary cutting blade to the handheld rotary cutting tool, and a blade guide comprising a larger portion and a smaller inner portion attached to the larger portion and adjacent to a first parallel face of the rotary blade, the larger portion defining a curved outer surface which is positioned between and abuts a top surface of the smaller inner portion and a bottom surface of the retainer to define a groove, such that when the groove is placed over the guide ridge an edge of the rotary blade is placed in a position adjacent to the outer sidewall of the guide ridge with the curved outer surface adjacent to the inner sidewall of the guide ridge.

2. The system of claim 1, wherein the ruler further comprises length marking indicia formed as a series of bumps disposed on the lower surface.

3. The system of claim 1, wherein the length marking indicia comprises a set of markings that form a grid pattern on the ruler.

4. The system of claim 1, wherein the planar section of the ruler includes multiple openings passing through the body from the upper surface to the lower surface.

5. The system of claim 1, wherein the inner portion and the larger portion of the blade guide are each generally C-shaped members.

6. The system of claim 1, wherein the blade guide further comprises a blade depth control by having the deflection with respect to the rotary blade able to be altered by a user to set the depth of the portion of rotary blade extending past the lower surface of the ruler during use.

7. The system of claim 6, wherein the blade guide deflects with respect to the rotary blade by pivoting on the rounded post on a frame of the hand held rotary cutter.

8. The system of claim 6, wherein the deflection with respect to the rotary blade of the blade guide that can be altered by a user is set by a pair of parallel walls that are slidably moved within the handle of the rotary cutting tool along the length of a tail portion of the blade guide.

9. The system of claim 1, wherein the hand held rotary cutting tool cutting portion comprises a deflectable blade guard with a rounded upper end that is slightly larger than the rotary blade and has a wall that is positioned adjacent the rotary blade.

10. The system of claim 9, wherein the blade guard deflects with respect to the rotary blade by pivoting on a rounded post on the frame of the hand held rotary cutter.

11. The system of claim 9, wherein the deflectable blade guard is maintained in a locked position such that it does not deflect away and expose the rotary blade unless unlocked by a user.

12. The system of claim 11, wherein the deflectable blade guard is unlocked by a user depressing a release button to slidably move a locking tab from a recess on the blade guard.

13. The system of claim 11, wherein the deflectable blade guard is unlocked by a user depressing a release button to withdraw a post from a slidably moveable guard stop which interacts with the blade guard.

14. The system of claim 1, wherein the blade guide comprises a larger portion and a smaller inner portion attached to the larger portion and adjacent to a first parallel face of the rotary blade, the larger portion defining a curved outer surface which is positioned between and abuts a top surface of the smaller inner portion and a bottom surface of the retainer to define a groove, such that when the groove is placed over the guide ridge the blade guide allows the handle of the hand held rotary cutting tool to be placed at various angles with respect to the ruler while maintaining the guide ridge within the groove.

15. The system of claim 1, wherein the blade guide is monolithic.

16. A hand held rotary cutting tool system comprising: a ruler for use with a rotary cutting tool, the ruler comprising a body with a planar section having an upper surface and a lower surface and a guide ridge disposed along an edge of the body, the guide ridge comprising an inner sidewall that extends from the upper surface to a ridge top surface and an outer sidewall extending from the ridge top surface to the lower surface; and a hand held rotary cutting tool comprising a handle;

a frame disposed at least partially within the handle; and a cutting portion disposed at one end of the handle, the cutting portion comprising a rotary blade having two parallel faces and a generally circular cutting edge rotatably mounted on a portion of the frame extending beyond the handle, an axle passing through rotary cutting blade, a retainer disposed on the axle to secure the rotary cutting blade to the handheld rotary cutting tool, and a blade guide comprising a larger portion and a smaller inner portion attached to the larger portion and adjacent to a first parallel face of the rotary blade, the larger portion defining a curved outer surface which is positioned between and abuts a top surface of the smaller inner portion and a bottom surface of the retainer to define a groove which corresponds to the guide ridge disposed on a cutting edge of the ruler, such that when the groove is placed over the guide ridge an edge of the rotary blade is placed in a position adjacent to the cutting edge of the ruler with the curved outer surface adjacent to the guide ridge.

17. The hand held rotary cutting tool system of claim 16, wherein the smaller inner portion and the larger outer portion of the curved blade guide are each generally C-shaped members.

18. The hand held rotary cutting tool system of claim 16, wherein the blade guide deflects with respect to the rotary blade by movement of the blade guide in a direction parallel to the first parallel face of the rotary blade.

19. The hand held rotary cutting tool system of claim 18, wherein the curved blade guide further comprises a blade depth control by having the deflection with respect to the rotary blade able to be altered by a user to set the depth of the portion of rotary blade extending past the lower surface of the ruler during use.

20. The hand held rotary cutting tool system of claim 19, wherein the curved blade guide deflects with respect to the rotary blade by pivoting on a rounded post on the frame of the hand held rotary cutter and the deflection with respect to the rotary blade of the blade guide can be altered by slidably moving a pair of parallel walls within the handle of the rotary cutting tool along the length of a tail portion of the curved blade guide.

21. The hand held rotary cutting tool system of claim 16, wherein the hand held rotary cutting tool cutting portion comprises a deflectable blade guard with a rounded upper end that is slightly larger than the rotary blade and has a wall that is positioned adjacent the rotary blade.

22. The hand held rotary cutting tool system of claim 21, wherein the blade guard deflects with respect to the rotary blade by pivoting on a rounded post on the frame of the hand held rotary cutter.

23. The hand held rotary cutting tool system of claim 21, wherein the deflectable blade guard is maintained in a locked position such that it does not deflect away and expose the rotary blade unless unlocked by a user depressing a release button to slidably move a locking tab from a recess on the blade guard.

24. The hand held rotary cutting tool system of claim 21, wherein the deflectable blade guard is unlocked by a user depressing a release button to withdraw a post from a slidably moveable guard stop which interacts with the blade guard.

25. The hand held rotary cutting tool system of claim 16, wherein the blade guide is monolithic.

26. A hand held rotary cutting tool comprising:

a handle;

a frame disposed at least partially within the handle; and a cutting portion disposed at one end of the handle, the cutting portion comprising a rotary blade having two parallel faces and a generally circular cutting edge rotatably mounted on a portion of the frame extending beyond the handle, an axle passing through rotary cutting blade, a blade guide including a central passage through which the axle passes and comprising a member with a smaller inner portion adjacent to a first parallel face of the rotary blade to define a transverse wall that is generally perpendicular to the first parallel face of the rotary blade and a larger outer portion disposed on the smaller inner portion to form a guide sidewall generally parallel to the first parallel face of the rotary blade such that a groove is defined by a gap between the guide sidewall and the first parallel face of the rotary blade which corresponds to a guide ridge disposed on a cutting edge of a ruler, such that placing the groove over the guide ridge will place the rotary blade in a position adjacent to the cutting edge of the ruler with the transverse wall of the blade guide over the guide ridge and the larger outer portion adjacent the guide ridge and the blade guide deflects with respect to the rotary blade by movement of the blade guide in a direction parallel to the first parallel face of the rotary blade and away from a long axis of the handle, wherein the inner portion and the larger outer portion of the blade guide are each generally C-shaped members, and a retainer disposed on the axle to secure the rotary cutting blade to the handheld rotary cutting tool.

27. The hand held rotary cutting tool of claim 26, wherein the blade guide further comprises a blade depth control by having the deflection with respect to the rotary blade able to be altered by a user to set the depth of the portion of rotary blade extending past the lower surface of the ruler during use.

28. The hand held rotary cutting tool of claim 26, wherein the blade guide deflects with respect to the rotary blade by pivoting on a rounded post on a frame of the hand held rotary cutter and the deflection with respect to the rotary blade of the blade guide can be altered by slidably moving a pair of parallel walls within the handle of the rotary cutting tool along the length of a tail portion of the blade guide.

* * * * *